US011148839B2

(12) United States Patent
Gross

(10) Patent No.: US 11,148,839 B2
(45) Date of Patent: Oct. 19, 2021

(54) DEVICE FOR PACKING DRUG PORTIONS

(71) Applicant: BECTON DICKINSON ROWA GERMANY GMBH, Kelberg (DE)

(72) Inventor: Dietmar Gross, Kelberg (DE)

(73) Assignee: BECTON DICKINSON ROWA GERMANY GMBH, Kelberg (DE)

( * ) Notice: Subject to any disclaimer, the term of this patent is extended or adjusted under 35 U.S.C. 154(b) by 568 days.

(21) Appl. No.: 15/482,182

(22) Filed: Apr. 7, 2017

(65) Prior Publication Data

US 2018/0290775 A1 Oct. 11, 2018

(51) Int. Cl.
*B65B 9/207* (2012.01)
*B65B 65/00* (2006.01)
*B65B 9/22* (2006.01)

(52) U.S. Cl.
CPC ..... *B65B 9/207* (2013.01); *B65B 9/22* (2013.01); *B65B 65/006* (2013.01)

(58) Field of Classification Search
CPC ..... B65B 9/22; B65B 9/207; B65B 65/006
USPC ..... 53/451
See application file for complete search history.

(56) References Cited

U.S. PATENT DOCUMENTS 2,832,271 A * 4/1958 Jarund ..... B65B 51/26 493/302
2,940,408 A * 6/1960 Monsees ..... B21D 5/10 29/557
3,636,826 A * 1/1972 Bowen ..... B65B 9/22 493/417
3,925,960 A * 12/1975 Saari ..... B65B 37/005 53/167

(Continued)

FOREIGN PATENT DOCUMENTS

CN 204124437 U 1/2015
CN 105228906 A 1/2016
CN 105416644 A 3/2016
CN 205469951 U 8/2016
DE 60113942 T2 7/2006

(Continued)

OTHER PUBLICATIONS

English translation of the International Preliminary Report on Patentability for Application No. PCT/EP2018/056274, dated Oct. 8, 2019, 6 pages.

(Continued)

*Primary Examiner* — Thanh K Truong
*Assistant Examiner* — Scott A Howell
(74) *Attorney, Agent, or Firm* — Morgan, Lewis & Bockius LLP

(57) ABSTRACT

The present disclosure provides a device for packaging drug portions, including a plurality of reservoir and dispensing stations, at least one conveyance and collecting apparatus, a packaging material feed, a packaging device, a folding and conveyance device included with the packaging device, a guide device including a receiving segment and a conveying segment, the conveying segment extending along the passage of the folding and conveyance device and guides drug portions into the tubular packaging material web, a first joining device arranged downstream of the folding and conveyance device, and a second joining device arranged downstream of the first joining device, which joins the tubular packaging material web at pre-specified intervals with respect to the direction of movement of the tubular packaging material, such that a continuous blister tube is created.

17 Claims, 9 Drawing Sheets

(56) References Cited

U.S. PATENT DOCUMENTS 4,043,098 A * 8/1977 Putnam, Jr. ..... B65B 9/2028 53/551
4,371,093 A * 2/1983 Berger ..... G07F 11/06 221/241
4,996,825 A * 3/1991 Bacon ..... B65B 51/30 53/451
5,167,107 A * 12/1992 Terminella ..... B29C 65/18 53/551
5,724,792 A * 3/1998 Domke ..... B65B 1/22 53/525
5,875,610 A * 3/1999 Yuyama ..... B29C 66/1122 53/75
5,904,027 A * 5/1999 Bonde ..... B29C 66/8222 53/374.3
6,047,521 A * 4/2000 Terminella ..... B65B 9/20 53/133.4
6,523,325 B1 2/2003 Forman et al.
6,691,891 B2 * 2/2004 Maldonado ..... A47F 1/125 211/59.3
6,769,229 B2 * 8/2004 Kinigakis ..... B65B 9/20 53/133.4
6,792,736 B1 * 9/2004 Takahashi ..... B65B 5/103 53/237
6,957,126 B2 * 10/2005 Kim ..... B65B 5/103 221/9
7,637,078 B2 * 12/2009 Ishiwatari ..... B65B 5/103 221/21
8,689,529 B2 * 4/2014 Rearick ..... B65B 9/093 156/510
9,126,704 B2 * 9/2015 Williams ..... B65D 31/02
9,340,305 B2 * 5/2016 Kuhn ..... B65B 31/045
9,610,219 B1 * 4/2017 Basso ..... B26D 7/0675
2005/0189369 A1 * 9/2005 Vlastakis ..... A47F 1/126 221/123
2010/0043358 A1 * 2/2010 Tsuruta ..... B29C 66/8161 53/463
2010/0077707 A1 4/2010 Kondo et al.
2012/0204514 A1 * 8/2012 Miyamoto ..... B65B 1/32 53/235
2013/0139480 A1 * 6/2013 Slenders ..... B65B 9/2028 53/575
2014/0013717 A1 * 1/2014 Monti ..... B29C 66/80 53/477
2014/0231493 A1 * 8/2014 Andersen ..... B65B 53/02 229/87.05
2015/0251789 A1 * 9/2015 Lokkers ..... B65B 5/103 414/273
2016/0083125 A1 * 3/2016 Oberdorfer ..... B65B 57/00 53/558

FOREIGN PATENT DOCUMENTS

WO WO-2009049998 A1 * 4/2009 ..... B65B 9/20
WO WO-2013034504 A1 3/2013

OTHER PUBLICATIONS

International Search Report for Application No. PCT/EP2018/056274, dated Apr. 18, 2018, 5 pages.

* cited by examiner

DEVICE FOR PACKING DRUG PORTIONS

TECHNICAL FIELD

The present disclosure relates to mechanical packaging devices and, in particular, to a device and method for packaging drug portions.

BACKGROUND

Known automatic blister packing machines include a plurality of reservoir and dispensing stations, each of which store multiple drug portions of a certain type of drug. Individual drug portions are dispensed from the reservoir and dispensing stations upon request, and are then fed to a packaging device where the drug portions are packaged and/or blister packed. The drug portions stored in the reservoir and dispensing stations are collected and blister packed individually for each patient according to orders prescribed by a doctor.

For the collection of multiple drug portions, corresponding reservoir and dispensing stations are activated by a control device to dispense one or more drug portions. The drug portions are stored in a storage container separated by a separation device of the reservoir and dispensing station, and are transferred via a dispensing opening to a conveyance device for packaging. The drug portions are conveyed by a conveyance device, with regular interconnections of a collection device, to a packaging device which packages and/or blister-packs individual or multiple drug portions.

SUMMARY

In many drug packaging settings, it is desirable to provide a storage and dispensing station with a reduced propensity to collect small flakes or particles of drug portions.

In one or more implementations, the present disclosure provides a plurality of reservoir and dispensing stations for dispensing individual drug portions, at least one conveyance and collecting apparatus for receiving and transferring the drug portions dispensed by the reservoir and dispensing stations, a packaging material feed for feeding a flexible and elongated packaging material web, a packaging device, a folding and conveyance device included with the packaging device, the folding and conveyance device having a packaging material receiving area including a passage, where the elongated packaging material web is fed into the passage and is molded into a tubular packaging material web, the shape of which is defined by the passage, the passage at least partially defining a packaging material overlap region, a guide device including a receiving segment and a conveying segment, the conveying segment extending along the passage of the folding and conveyance device and guides drug portions into the tubular packaging material web, a first joining device arranged downstream of the folding and conveyance device for joining the tubular packaging material web at the packaging material overlap region in a direction of movement of the tubular packaging material web, and a second joining device arranged downstream of the first joining device, which joins the tubular packaging material web at pre-specified intervals with respect to the direction of movement of the tubular packaging material web, such that a continuous blister tube is created.

In one or more implementations, the present disclosure provides a method of forming a blister tube containing drug portions with a packaging device, comprising, molding an elongated packaging material into a tubular packaging material web by a folding and conveyance device having a packaging material receiving area including a passage, where the elongated packaging material web is fed into the passage and is molded into the tubular packaging material web, the shape of which is defined by the passage, the passage at least partially defining a packaging material overlap region, guiding drug portions into the tubular packaging material web by a guide device that includes a receiving segment and a conveying segment, the conveying segment extending along the passage of the folding and conveyance device, joining the tubular packaging material web at the packaging material overlap region in a direction of movement of the tubular packaging material web by a first joining device arranged downstream of the folding and conveyance device, and joining the tubular packaging material web at pre-specified intervals with respect to the direction of movement of the tubular packaging material web by a second joining device arranged downstream of the first joining device, such that a continuous blister tube is created.

In one or more implementations, the present disclosure provides a method of forming a blister tube containing drug portions with a packaging device, comprising molding an elongated packaging material into a tubular packaging material web by a folding and conveyance device having a packaging material receiving area including a passage, where the elongated packaging material web is fed into the passage and is molded into the tubular packaging material web, the shape of which is defined by the passage, the passage at least partially defining a packaging material overlap region.

BRIEF DESCRIPTION OF THE DRAWINGS

The devices according to implementations of the present disclosure are described in greater detail below, with reference to the appended drawings, wherein.

DETAILED DESCRIPTION

Figure 1:
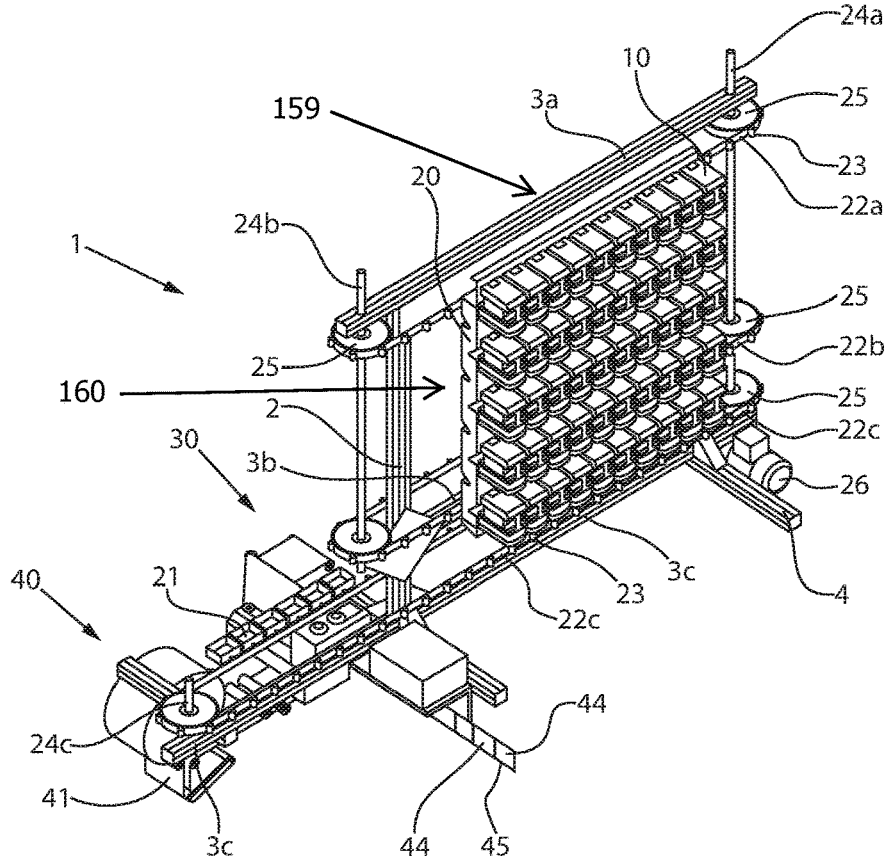
Fig. 1 PRIOR ART
FIG. 1 is a perspective view of a device for packing drug portions according to exemplary implementations of the present disclosure.

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions are provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

Modern automatic blister packing machines typically have a plurality of reservoir and dispensing stations, and likewise a plurality of collecting devices in which combinations of drug portions are stored temporarily before they are transferred to a packaging device.

The blistering process involves a packaging material web being molded by a packaging device into a blister tube with a plurality of blister pouches arranged sequentially. For this purpose, a flexible, elongated packaging material web is fed to the packaging device via a packaging material feed. The packaging material web is folded into a V shape in a longitudinal direction, and welded at pre-specified intervals transverse to the direction of movement of the packaging material. A partially-closed blister pouch is formed, and the drug portions are transferred into the blister pouch. Due to the preparation of the packaging material web, a receiving space, in some implementations, has the form of an inverted and hollow pyramid, although other forms are certainly possible.

After the transfer, the partially-closed blister pouch is closed by welding in the direction of movement, and by a further welding transverse to the direction of movement (which can also form the first transverse weld for a subsequent blister pouch).

Accordingly, this disclosure provides a device for packaging drug portions with a lower error rate than other systems and methods. The device according to some implementations of the present disclosure includes a plurality of reservoir and dispensing stations to dispense individual drug portions, at least one conveyance and collecting apparatus to receive and carry the drug portions dispensed by the reservoir and dispensing stations, and a packaging material feed to feed a flexible, elongated packaging material web.

The device according to the disclosure also has a packaging device including a folding and conveyance device. The folding and conveyance device has a packaging material receiving area with a passage, and feeds the elongated packaging material web to the passage, which in turn molds the elongated packaging material web in the direction of movement into a tubular packaging material web, the shape of which is defined by the passage. A packaging material overlap region, as well as a guide device, is arranged above the folding and conveyance device, which includes a receiving segment for drug portions and a conveying segment which extends in the direction of the passage and which guides drug portions into the tubular packaging material web.

In order to mold the packaging material web, which has been pre-shaped into a tube by the folding and conveyance device, into closed blister pouches, a first joining device is arranged downstream of the folding and conveyance device. The first joining device joins the tubular packaging material web at the packaging material overlap region in the direction of movement of the tubular packaging material such that a tube with a closed circumference is created. Also included is a second joining device arranged downstream of the first joining device, which joins the tubular packaging material web at pre-specified intervals with respect to the direction of movement, such that pouch-shaped receiving segments open at their top are created. The second joining device joins the packaging material web approximately orthogonally and/or transversely to the direction of movement of the packaging material web, wherein the precise alignment of the joining site depends on the shape of the blister pouch which is desired.

According to exemplary implementations of the disclosure, the packaging material web is molded into a plurality of receiving spaces, or pouch-shaped receiving spaces, which are open at their tops such that the risk of drug portions falling out is reduced.

Additionally, in prior designs, it was necessary to feed the packaging material web at an angle, for example at a 45 degree angle, and to then transfer the drug portions from above at the angle into the partially closed blister pouches. The drug portion feed direction deviated at the receiving space from the direction of movement of the packaging material web, forming the angle. However, according to the present disclosure, drug portions are conveyed into the receiving spaces according to the direction of movement of the packaging material web, since a pouch-shaped packaging material web segment is present before the individual blister pouch is formed. Thus, according to the present disclosure, there is a very low error rate in the blister packing of the drug portions, even at high processing speeds.

The second joining device is designed such that it is suitable for high work speeds. To periodically produce joining sites substantially transverse to the direction of movement, the packaging material web can be halted according to a clock cycle, as an example. During the halt, the packaging material web can then be joined by suitable joining processes.

However, because high processing speeds are desired, it may be advantageous if the packaging material web is not halted periodically. Accordingly, the joining device can have, by way of example, opposing, rotating welding rolls with one or more welding technologies or elements. The interval at which the joining sites are created depends on multiple factors, such as the speed of operation of the packaging material web, the rotation speed of the welding rolls and the number of welding elements per welding roll.

The number of the drug portions which are blister packed per blister pouch varies according to each patient's required portions. In order to ensure that the packaging material web is used optimally, it may be desirable to produce blister pouches with different lengths. As such, in some implementations of the present disclosure, the second joining device has a drive device by which the second joining device can be moved in, and opposite to, the direction of movement of the tubular packaging material web.

In such an implementation, the second joining device is moved together with the packaging material web when the packaging material web is joined (transverse to the direction of movement), and is then moved opposite the direction of movement after the joining. As soon as the drug portions are conveyed to the pouch-shaped receiving segment, the joining process begins again. The length of the blister pouch can therefore be varied without modifying the speed of operation of the packaging material web by varying the length of time between the individual joining processes.

Typically, blister tubes with a plurality of blister pouches are created during blister packing in the known automatic blister packing machines. The blister tubes are typically stored outside the automatic blister packing machines in the form of rolls. The blister pouches of a blister tube are essentially visually identical to each other, such that it is necessary to separate them after they are conveyed out of the automatic blister packing machine.

As such, in some implementations of the present disclosure, the device for packaging drug portions has a cutting device with a cutting element by which the blister tube can be severed at pre-specified intervals with respect to the direction of movement of the blister tube. The precise manner in which the separation is performed depends on the precise design of the blister tube. Typically, a transverse joining site is part of two blister pouches: that is, a 'lower' end of one blister pouch and an 'upper' end of another blister pouch. The separation then occurs precisely at a joining site. If each blister pouch has two of its own joining sites, the separation can occur between two joining sites.

In some implementations, the blister tube can be severed when the blister tube is produced. There is no need for the separation point to be located at another location. It is also possible to easily produce blister tubes of different lengths using a corresponding device. It is also contemplated that the blister pouch is separated immediately after production.

Even pre-separated blister tubes have multiple blister pouches, and these blister pouches generally correspond to multiple prescriptions, patients and/or administration times. Therefore, it is usually necessary to subsequently separate the blister pouches. In some implementations of the present disclosure, the cutting element includes a plurality of cutting teeth and the blister tube and the cutting element are arranged to be able to move relative to each other such the blister tube can be severed or perforated. The blister tube can therefore be both severed and perforated by one component. As such, by way of example, individual blister tubes can be produced for each patient, wherein the individual blister pouches thereof can be easily detached from each other and opened due to the perforations inserted between them. The manner in which the separations/perforations are distributed can be varied according to the application.

In some implementations of the present disclosure, the cutting device is functionally assigned to, or operatively associated with or attached to, the second joining device. As such, it is possible to carry out the separations and/or perforations. This is because it is not necessary to separately and/or precisely detect the point where the separation and/or perforation is made, since the cutting element is moved together with the joining device.

In some implementations, the second joining device has a joining element in which the cutting element is accommodated, and specifically in such a manner that the joining element extends upstream and downstream of the cutting element in the direction of movement of the packaging material web. This implementation makes the perforation and separation particularly simple and precise, since the separation/perforation always take place at a joining site produced in a straight line.

The disclosure also relates to use of a packaging device having a folding and conveyance device, wherein the same has a packaging material receiving area with a passage, and is designed such that the elongated packaging material web is fed to the passage. The passage is designed such that the elongated packaging material web is molded in the direction of movement into a tubular packaging material web, the shape of which is defined by the passage, and has a packaging material overlap region, as well as a guide device arranged above the folding and conveyance device for receiving segments for drug portions. A conveying segment extends in the direction of the passage of the folding and conveyance device and guides drug portions into the tubular packaging material web. A first joining device is arranged downstream of the folding and conveyance device which joins the tubular packaging material web at the packaging material overlap region in the direction of movement of the tubular packaging material. A second joining device is arranged downstream of the first joining device, which joins the tubular packaging material web at pre-specified intervals with respect to the direction of movement to produce a blister tube holding drug portions.

The disclosure also relates to the use of a folding and conveyance device for molding a packaging material web moving in a direction of web movement to produce a blister tube containing drug portions. The folding and conveyance device includes a packaging material receiving area with a passage, and is designed such that an elongated packaging material web is fed to the passage. The passage is designed such that the elongated packaging material web is molded in the direction of movement into a tubular packaging material web, the shape of which is defined by the passage and has a packaging material overlap region.

FIG. 1 is a perspective view of a device 1 for packing drug portions according to exemplary implementations of the present disclosure. The device 1 includes a central frame 159 having a plurality of vertical struts 2 (only one vertical strut 2 is visible in FIG. 1), three horizontal struts 3*a*, 3*b*, 3*c* and multiple stand struts 4. The lower horizontal strut 3*c* extends substantially along an entire length of the device 1, while the upper horizontal struts 3*a*, 3*b* extend along a portion of the length of the device 1.

A conveyance and collecting apparatus 160 is arranged on the central frame 159 and includes three axles 24*a*, 24*b*, 24*c* which are accommodated in corresponding bore holes of the horizontal struts 3*a*, 3*b*, 3*c*. The axles 24*a*, 24*b*, 24*c* comprise one (24*c*), two (24*b*), or three (24*a*) deflection rollers 25, wherein transport belts 22*a*, 22*b*, 22*c* are arranged between and/or around the deflection rollers 25. The transport belts 22*a*, 22*b*, 22*c* have various lengths according to the arrangement of the axles 24*a*, 24*b*, 24*c* on the horizontal struts 3*a*, 3*b*, 3*c*. In some implementations, the two upper transport belts 22*a*, 22*b* have the same lengths as one another, while a length of the lower transport belt 22*c* is greater than a length of either of the two transport belts 22*a*, 22*b* and is substantially equal to the entire length of the device 1.

As can be seen in FIG. 1, elongated conveyance devices 20 are arranged, via retaining elements 23, on, above and/or between the transport belts 22*a*, 22*b*. Collecting devices 21 are arranged, via retaining elements 23, on and/or above the lower transport belt 22*c*. It is to be understood that more or fewer of the elongated conveyance devices 20 and more or fewer of the collecting devices 21 than are shown in the figures are included within the scope of this disclosure.

The device 1 includes a drive 26 which drives and rotates the axle 24*a*, and a rotation of axle 24*a* causes a corresponding movement of the transport belts 22*a*, 22*b*, 22*c*. As the transport belts 22*a*, 22*b*, 22*c* are all moved via rotations of axle 24*a*, the transport belts 22*a*, 22*b*, 22*c* move in the direction of axle 24*a* rotation with the same speed as each other. Accordingly, the conveyance devices 20 and the collecting devices 21 are movable between the axles 24*a* and 24*b* at the same speed and direction, and are also aligned with each other in exemplary implementations of the present disclosure.

Different drug portions are arranged in a plurality of reservoir and dispensing stations 10, and only one partial matrix of reservoir and dispensing stations is indicated in FIG. 1. The reservoir and dispensing stations 10 are fixed relative to the device 1. The reservoir and dispensing stations 10 include a reservoir portion for storing drug portions, and a dispensing portion via which individual drug portions are transferred upon request into the conveyance device 20. An exemplary implementation, as shown in FIG. 1, includes five rows of reservoir and dispensing stations 10, such that the conveyance device 20 includes five receiving openings via which drug portions are received.

In operation, the conveyance devices 20 are moved past, or relative to, the reservoir and dispensing stations 10 via the transport belts 22*a*, 22*b*. Drug portions can be dispensed during such relative motions of the conveyance devices 20 from the reservoir and dispensing stations 10 to a given conveyance device 20, which then transfers the drug portions to a collecting device 21 arranged below the conveyance device 20 and moved in unison with the conveyance device 20. In exemplary implementations of the present disclosure, a conveyance device 20 moves, or is movable, past all of the reservoir and dispensing stations 10 of the device 1, such that each type of drug stored in the device 1 can be fed to each collecting device 21 upon each passing movement.

The device 1 according to implementations of the disclosure includes a packaging device 30 and a packaging material feed 40. In some implementations, the packaging device 30 and packaging material feed 40 are disposed near, or below, where the transport belts 22*a*, 22*b* do not extend and below the transport belt 22*c*, and therefore below the collecting devices 21 fixed to the transport belt 22*c*. An elongated packaging material web 41 is fed to the packaging device 30 via the packaging material feed 40. The packaging device 30 forms a blister tube 45 from the elongated packaging material web 41 having a plurality of blister pouches 44. During or after this forming process, drug portions which are temporarily stored in the collecting devices 21 are transferred to respective blister pouches 44 as, or after, they are formed. The shaping of the blister pouches 44 and the transfer of the drug portions into the blister pouch 44 are described below with reference to the following figures.

In exemplary implementations, the conveyance and collecting apparatus 160 has a particular degree of complexity in its design and/or construction, and enables a particular blister packing speed as well as access to a large number of different types of drugs. However, it is to be understood that a conveyance and collecting apparatus 160 of greater or less complexity, or another conveyance and collecting apparatuses 160, is also within the scope of this disclosure. The conveyance and collecting apparatus can 160, by non-limiting example, include one stationary collecting device 21 to which are fed all combinations of drug portions. It is also contemplated that only one conveyance device 20 is included which can receive drug portions from all of the reservoir and dispensing stations 10.

Figure 2:
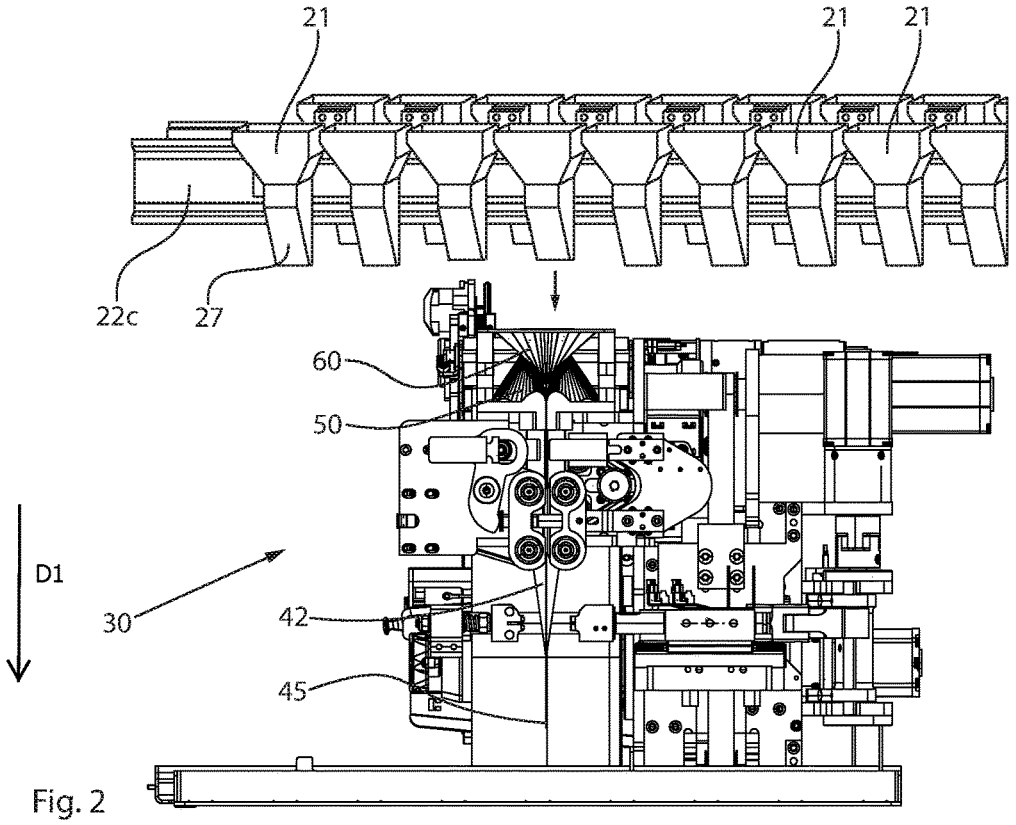
FIG. 2 is a perspective view of the device of FIG. 1, also illustrating a conveyance and collecting apparatus according to exemplary implementations of the present disclosure.

Turning to FIG. 2, an orientation of the packaging device 30 relative to a portion of the conveyance and collecting apparatus 160 is shown. In particular, an orientation of a guide device 60 of the packaging device 30, disposed below the collecting devices 21 can be seen. To transfer a drug portion temporarily stored in a collecting device 21, a dispensing flap 27 of a corresponding collecting device 21 is opened, and the drug portions disposed in the corresponding collecting device 21 fall into the guide device 60, which feeds the drug portion, directly or indirectly, into a blister pouch 44.

Figure 9A:
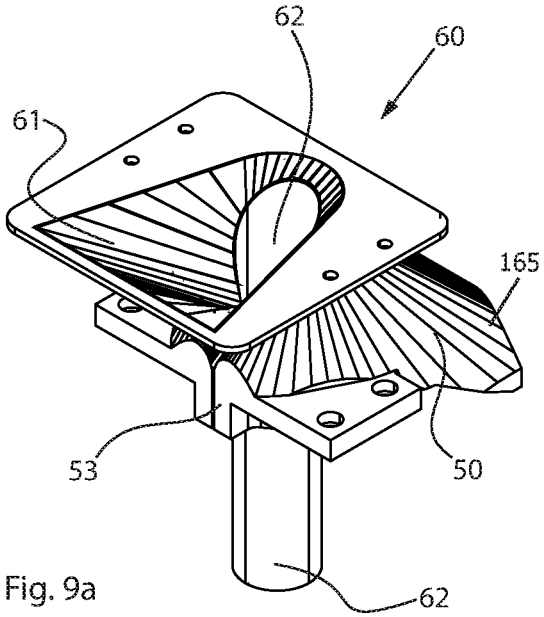
FIGS. 9*a*-9*c* are views of a folding and conveyance device and a guide device, according to exemplary implementations of the present disclosure.
Figure 9B:
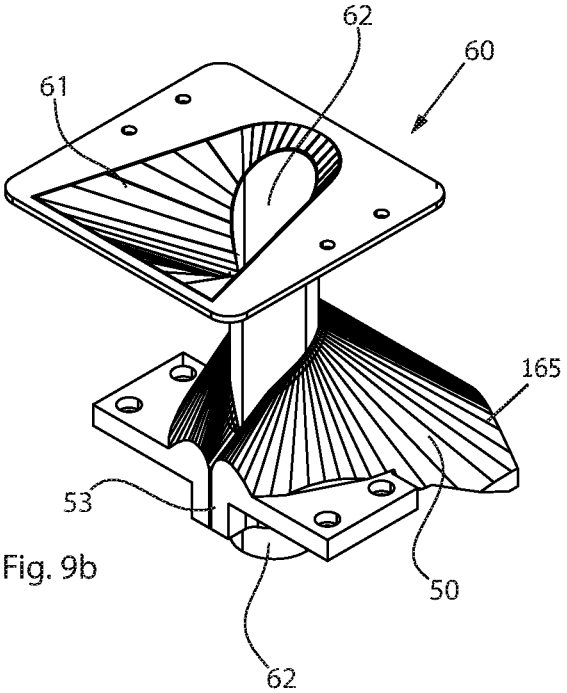
Figure 9C:
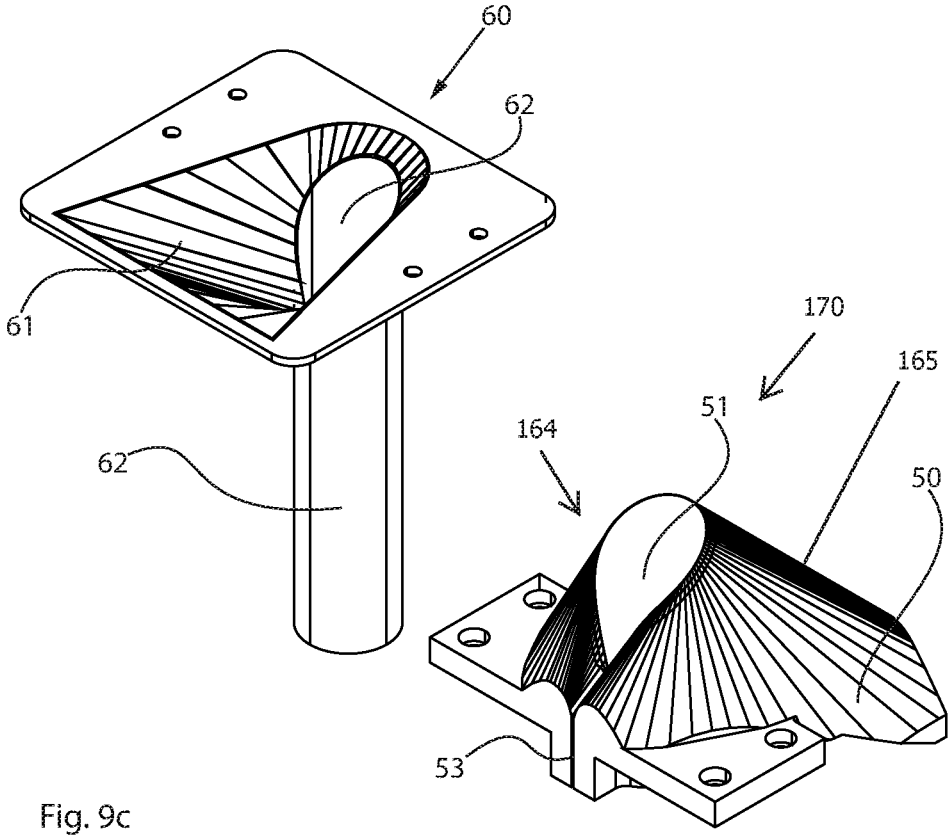

FIGS. 3*a*-3*d* show various views of the packaging device 30. The packaging device 30 includes the guide device 60, which accepts combinations of drug portions from the collecting devices 21. The guide device 60 includes a receiving segment 61 which may be formed in the shape of a funnel. The guide device 60 also includes a conveying segment 62, as shown in FIGS. 9*a*-9*c*, which feeds the drug portions into the packaging material web 41 which is pre-shaped into a blister tube 45 open at the top.

A folding and conveyance device 50, which is also described below with reference to FIGS. 9*a*-9*c*, narrows conically at or near a center portion 164 of the conveyance device 50 and includes a central passage 51 by which the packaging material web 41 is formed into a tubular shape. In some implementations of the present disclosure, the folding and conveyance device 50 is formed in the shape of a crater, or formed in the shape of a raised conical or frusto-conical form including a concave hole, or passage, therethrough, wherein the packaging material web 41 is guided to the center portion 164 via outer sides 165. The folding and conveyance device 50 also includes a packaging material receiving area 170 for receiving the packaging material web 41.

The packaging device 30 includes a first joining device 70 and a second joining device 90 which form separate blister pouches 44 in the packaging material web 41. In some implementations of the present disclosure, the first joining device 70 is arranged downstream of the guide device 60 with respect to a direction of movement of the packaging material web 41, shown as direction D1 in FIGS. 2, 3*a* and 7, and the second joining device 90 is arranged downstream of the first joining device 70.

Figure 3A:
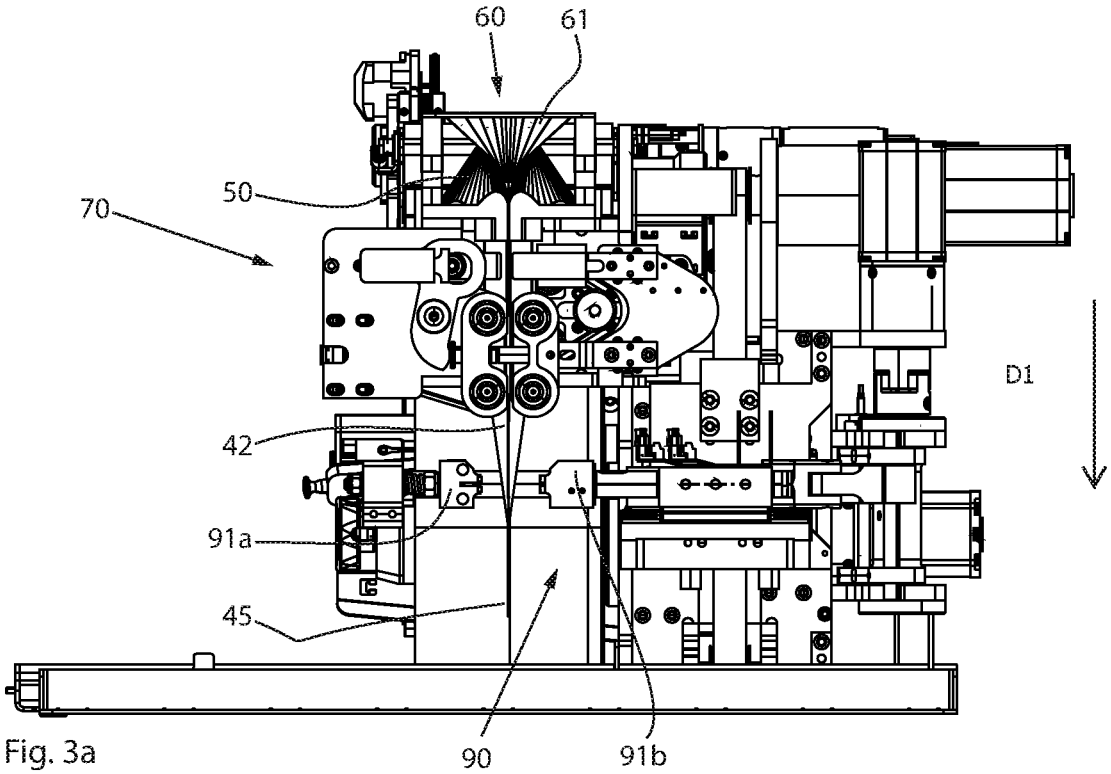
FIGS. 3*a* and 3*b* are front and top views of the device of FIG. 1.
Figure 3B:
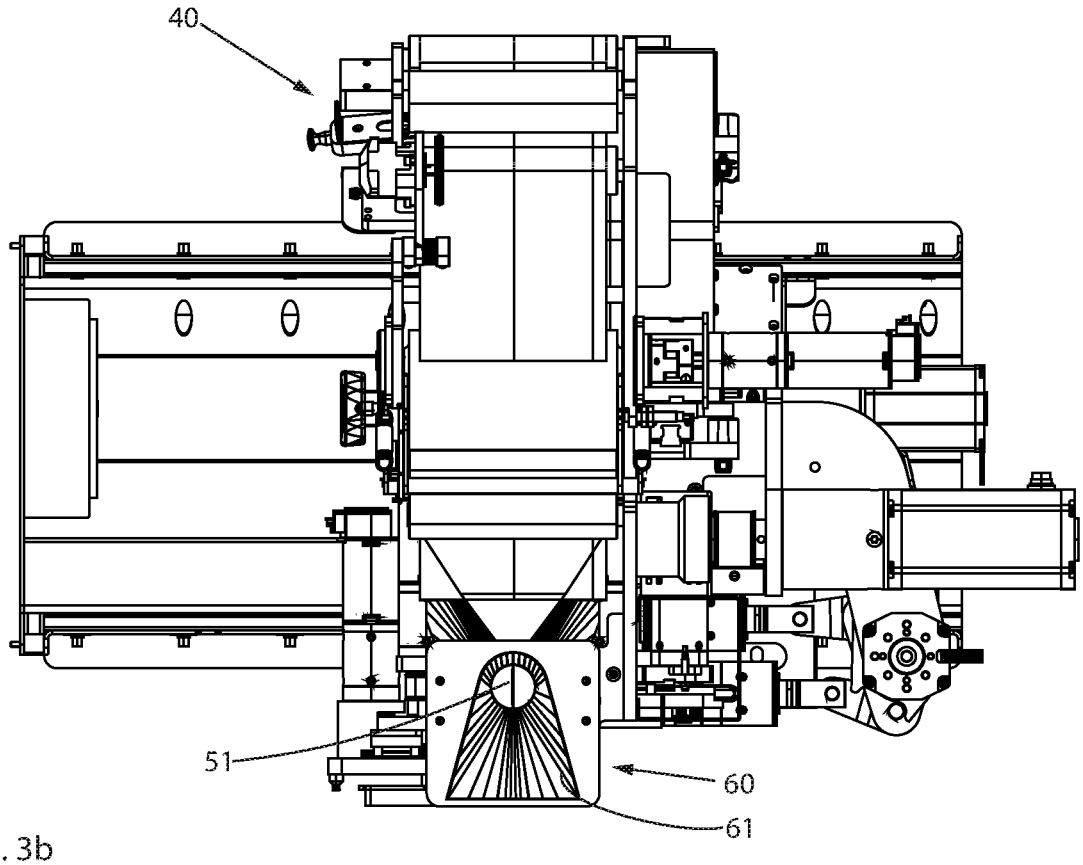

As described above, the packaging material web 41 is pre-shaped into a tubular form by the folding and conveyance device 50, but may be open along a circumference of the tubular shape, as well as at the top and bottom, or leading and trailing ends, of the tubular shape. The first joining device 70 arranged downstream of the guide device 60 joins the packaging material web 41 parallel to the direction D1 of packaging material web 41 movement, such that a closed tube of packaging material web 41 is created. Such a closed tube 42 of packaging material web 41 is shown in FIG. 3*a*.

The second joining device 90 is arranged below, or downstream of, the first joining device 70. The closed tube 42 is joined transverse to the direction D1 of packaging material web 41 movement by the second joining device 90, forming blister pouch 44 shapes. In some implementations, the second joining device 90 is designed in such a manner that it can be moved with, and opposite to, the direction D1 of movement of the packaging material web 41. For the joining and/or application of the joining site into the tubular packaging material web 42, the joining elements 91*a*, 91*b* are moved together. As soon as the joining elements 91*a*, 91*b* are moved together, the second joining device 90 is moved downward, or downstream, in the direction D1 of movement of the tubular packaging material web 42. The duration of the movement depends on the amount of time required to ensure the joining. The joining site is typically a welded seam, however other types of joining are contemplated.

As soon as the joining site is produced, the joining elements 91*a*, 91*b* are moved away from each other, and the second joining device 90 as such is moved "upward" opposite the direction D1 of movement of the tubular packaging material web 42. As soon as the "lower" joining site has been applied, drug portions can be fed from above via the guide device 60 to the blister pouch 44, open at its top.

During the actual insertion of the drug portions, the movement of the packaging material web 41 is not halted. Rather, the packaging material web 41 continues to be moved in the direction D1 of movement such that it continues to advance during the filling process. The actual filling and/or the insertion of drug portions into the blister pouches 44 is performed in a synchronized manner.

As soon as all of the drug portions have been inserted, the joining elements 91*a*, 91*b* of the second joining device 90 are moved together once again, and the second joining device 90 is moved downward with the packaging material web 41. A further joining site is applied, or created, which is simultaneously the "upper" joining site of the blister pouch 44 just created, and the "lower" joining site of the blister pouch 44 which will be made subsequently.

Figure 3D:
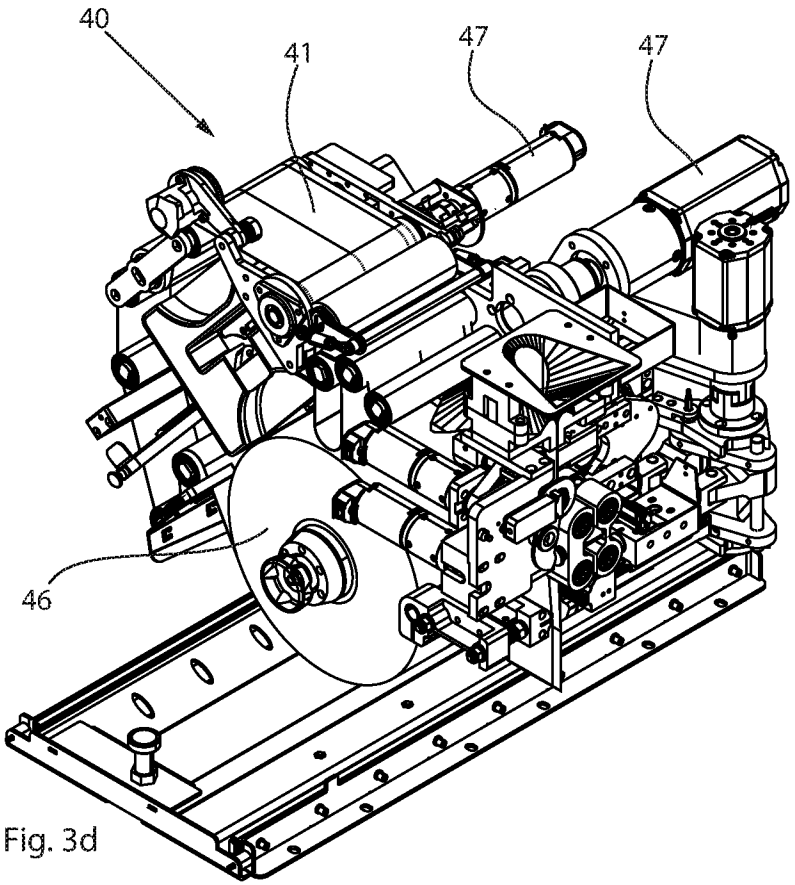
FIGS. 3*c* and 3*d* are front and side perspective views of the device of FIG. 1.
Figure 3C:
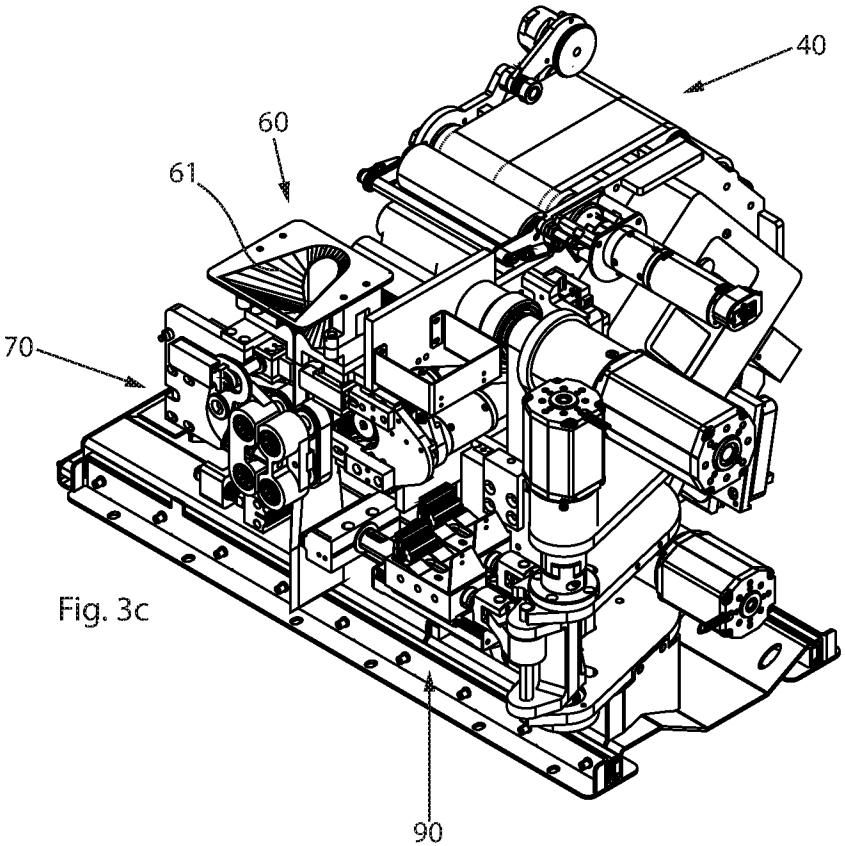

The elongated packaging material web 41 is fed to the folding and conveyance device 50 via a packaging material feed 40, shown in detail in FIG. 3*d*. The packaging material feed 40 includes a central packaging material roll 46 and various deflection rollers which feed the elongated packaging material web 41 to the folding and conveyance device 50. In some implementations, as shown in FIG. 3*d*, two of the deflection rollers are coupled to a drive 47. In some implementations, the packaging material feed 40 is a central, integrated or included component of the packaging device 1. In some implementations, the packaging material feed 40 is arranged outside of, or remotely from, the device 1 to enable rapid changes of the packaging material roll 46.

Figure 4:
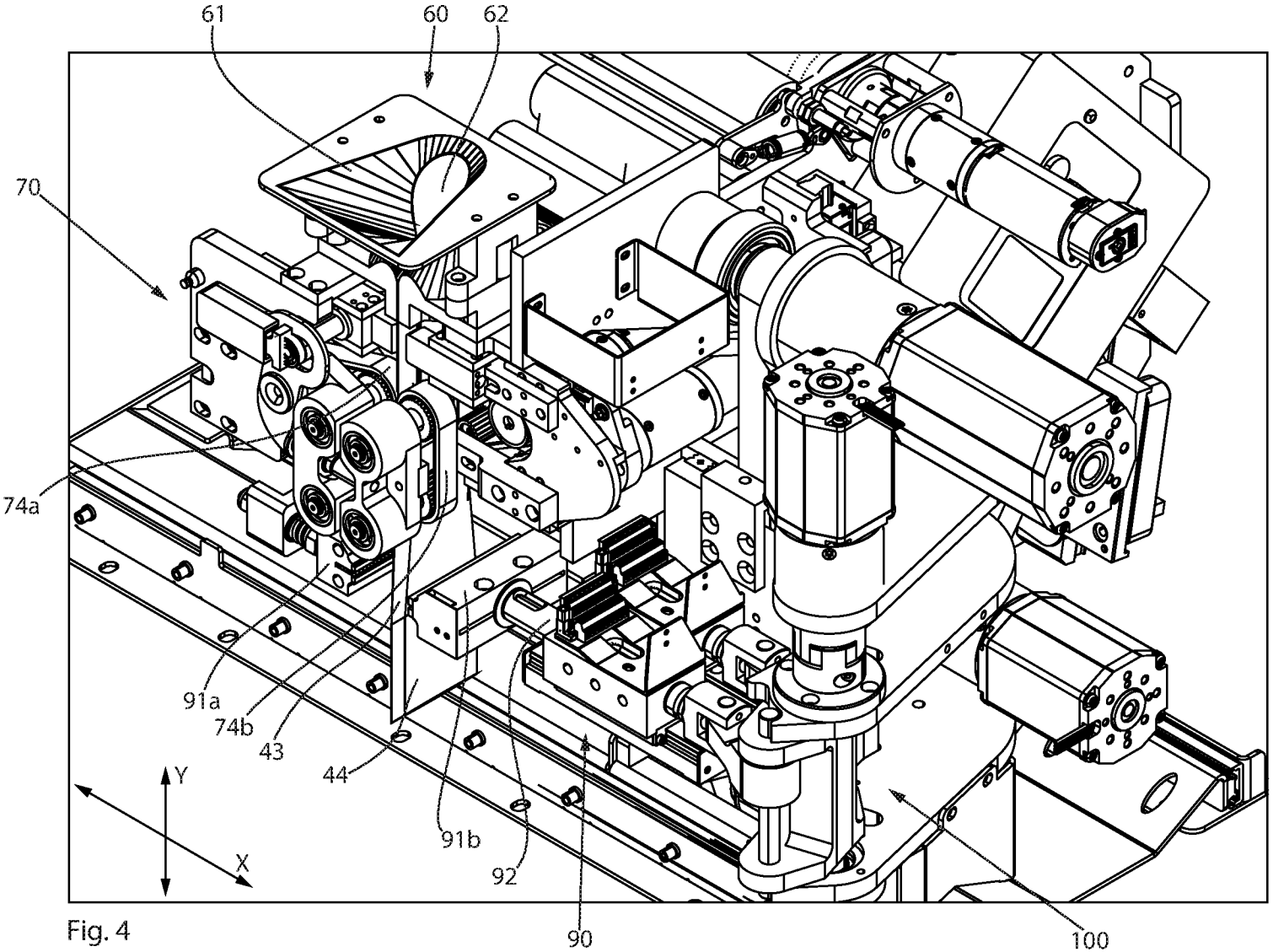
FIG. 4 is a front perspective view of the device of FIG. 1.

Turning to FIG. 4, it can be seen that a drive device 100, which moves part of the second joining device which includes the joining elements 91*a*, 91*b* and can be moved towards and away from the packaging material web 41, is operatively associated with the second joining device 90. In some implementations, the first joining device 70 has two drive belts 74*a*, 74*b* which encompass a packaging material overlap region 43. The packaging material overlap region 43 is formed due to the special construction of the folding and conveyance device 50. The actual joining of packaging material 41 parallel to the direction of movement of the packaging material 41 takes place in the packaging material 41 overlap region 43.

A horizontal adjusting mechanism 92 is operatively associated with the joining element 91*b* and moves the joining element 91*b* can be moved in an X, or a horizontal, direction toward the tubular packaging material web 41 to apply a joining site, and away from the tubular packaging material web 42 after the application of the joining site, as can be seen in FIG. 4. The drive device 100 moves the second joining device 90 in a Y, or a vertical, direction in, and opposite to, the direction D1 of movement of the packaging material web 41.

Figure 5:
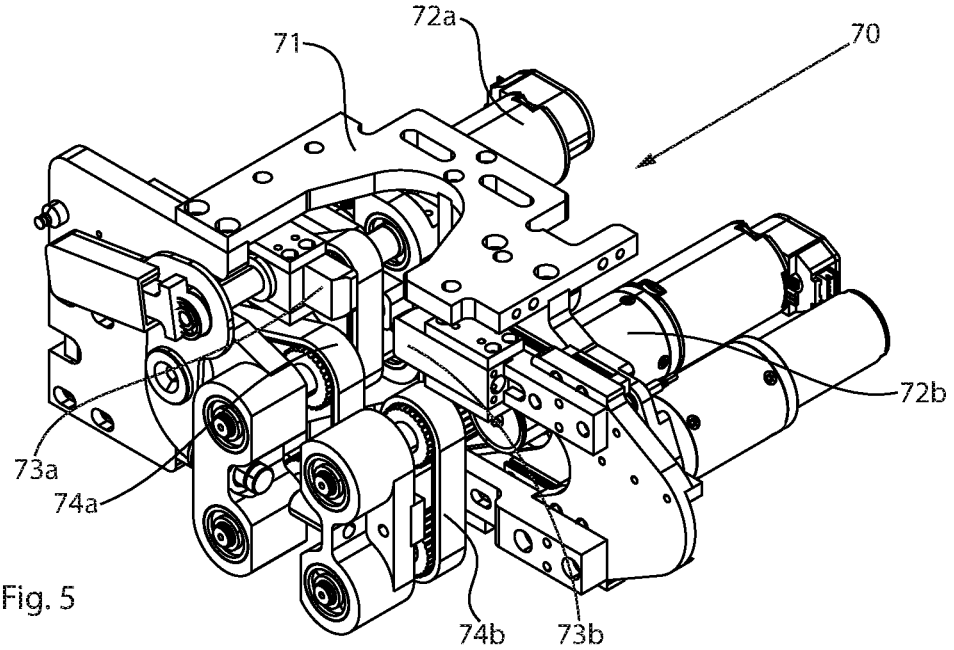
FIG. 5 is a perspective view of a joining device of the device of FIG. 1, according to exemplary implementations of the present disclosure.

Turning to FIG. 5 the first joining device 70 includes a receiving plate 71 on which the first joining device 70 is arranged. To support the movement of the packaging material web 41 pre-shaped in the form of a tube 42, the first joining device 70 has two drive belts 74*a*, 74*b* which encompass the packaging material overlap region 43. The elongated packaging material web 41 is pre-shaped in the form of a tube 42, and the packaging material overlap region 43 is formed by the folding and conveyance device 50. The actual joining in the direction of material web 41 movement takes place in the packaging material overlap region 43. For this purpose, the first joining device 70 includes joining elements 73*a*, 73*b* which contact the packaging material 41 to join the packaging material web 41. The joining elements in FIG. 5 are shown spaced apart from each other for the sake of clarifying the individual components. The joining elements 73*a*, 73*b* and the drive belts 74*a*, 74*b* are coupled to drives 72*a*, 72*b*.

Figure 6A:
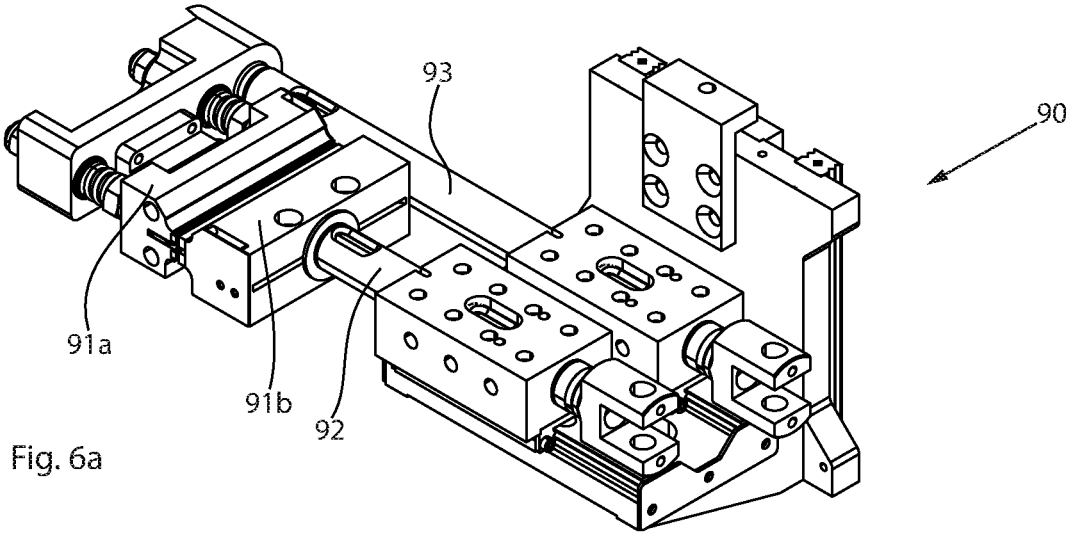
FIG. 6*a* is a perspective view of a second joining device of the device of FIG. 1, according to exemplary implementations of the present disclosure.
Figure 6B:
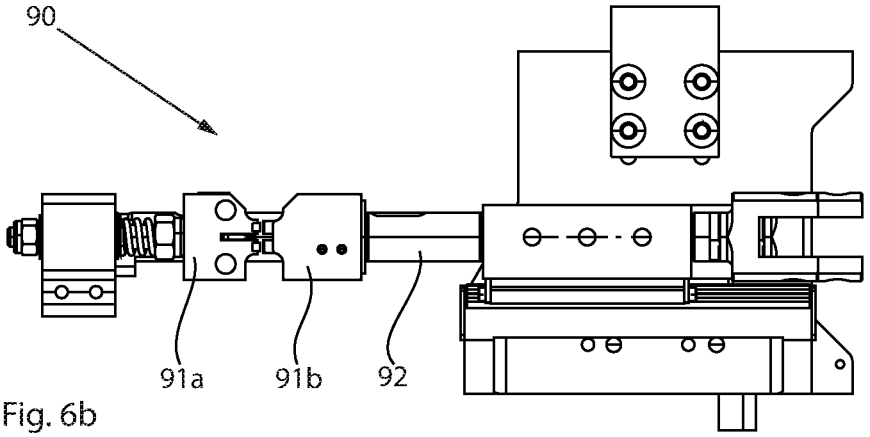
FIG. 6*b* is a front view of the second joining device of FIG. 6*a*.

FIGS. 6*a* and 6*b* show two views of the second joining device 90. For the purpose of applying a joining site to the packaging material web 41, the second joining device 90 includes two joining elements 91*a*, 91*b* which can be moved horizontally. For this purpose, the second joining device 90 has two horizontal adjusting mechanisms 92, 93 which can be moved independently of each other. The section of the second joining device 90 shown in FIGS. 6*a* and 6*b* can be moved via a drive device 100 in, and opposite to, the direction D1 of movement of the packaging material web 41.

Figure 7:
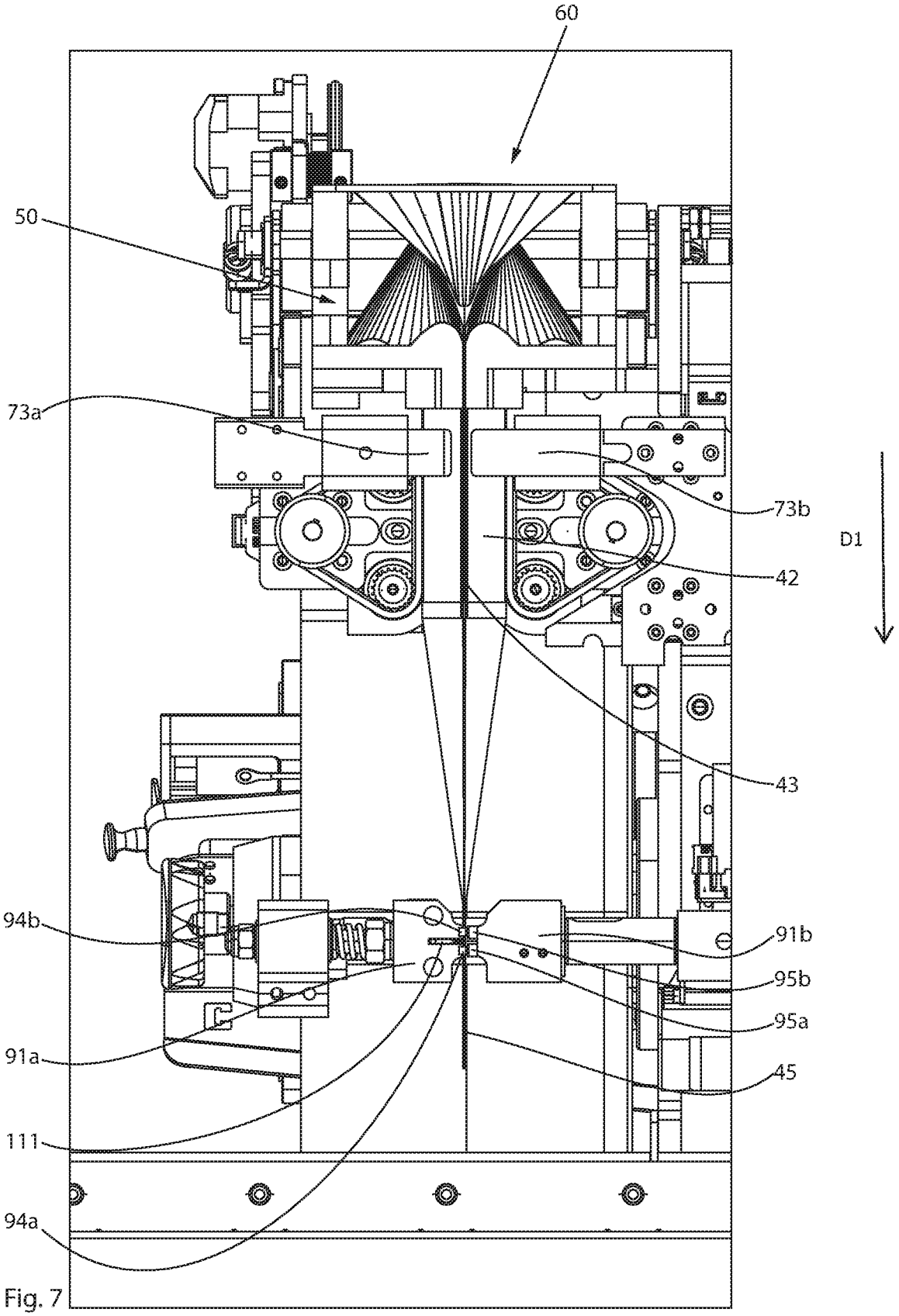
FIG. 7 is a front view of a packaging device of the device of FIG. 1, according to exemplary implementations of the present disclosure.

FIG. 7 shows the area where the drug portions are inserted and the packaging material web 41 is joined, as well as the course of the packaging material web 41 through the first and the second joining devices 70, 90. The folding and conveyance device 50 shapes the packaging material web 41 into a tubular packaging material web 42 having a packaging material overlap region 43, which is joined together downstream of the folding and conveyance device 50 by the joining elements 73*a*, 73*b*. In some implementations, the overlap region 43 is welded. The application of the horizontal joining sites occurs at the second joining device 90 arranged downstream of the first joining device 70. In some implementations, a welded seam is applied. Specifically, the joining element 91*a* has, for this purpose, two welding edges 94*a*, 94*b* which press the packaging material web 41 being welded against two counter edges 95*a*, 95*b* of the joining element 91*a* during the actual application of the weld. In some implementations, the joining element 91*a* has a cutting element 111 which is incorporated into the center of the joining element 91*a*, and specifically in such a manner that the welding edges 94*a*, 94*b* are arranged downstream and upstream of the cutting element 111, respectively, with respect to the direction D1 of movement of the packaging material web 41.

Figure 8C:
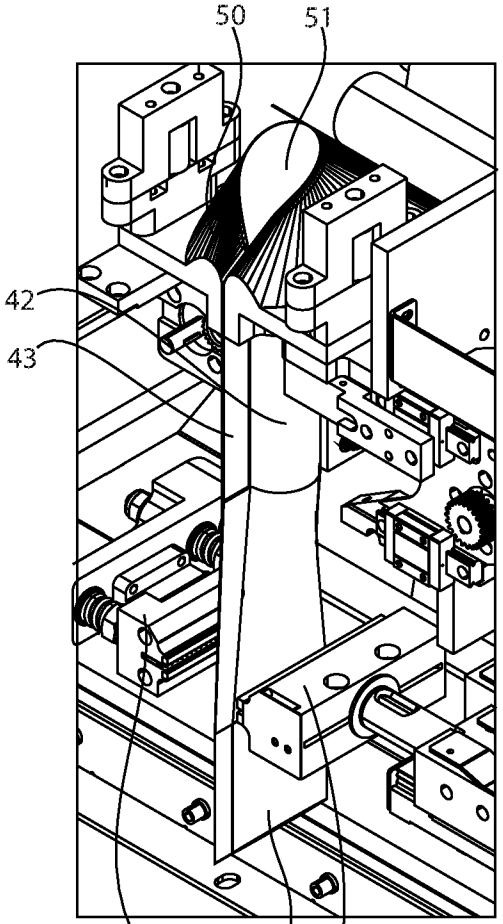
FIGS. 8*a*-8*c* are views of the device of FIG. 1 and the conveyance and collecting apparatus of FIG. 2.
Figure 8B:
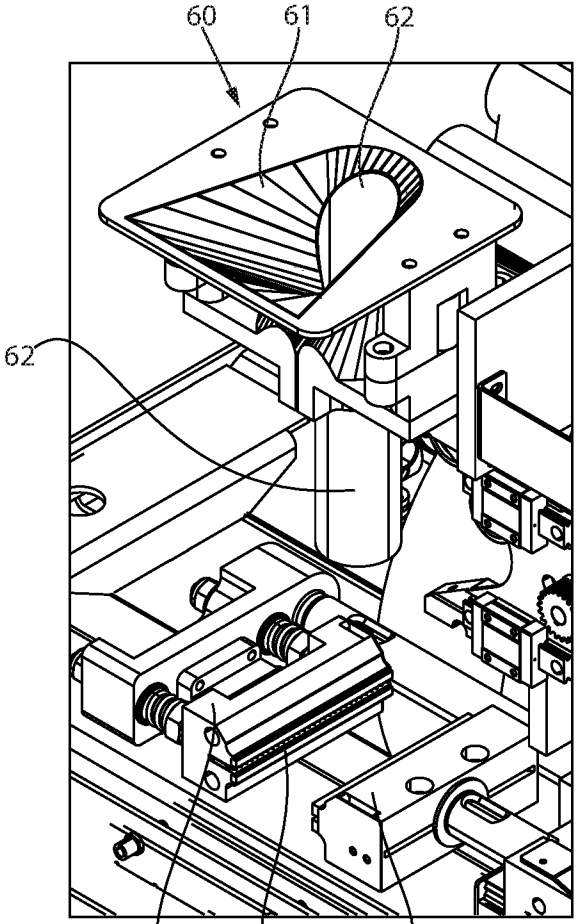
Figure 8A:
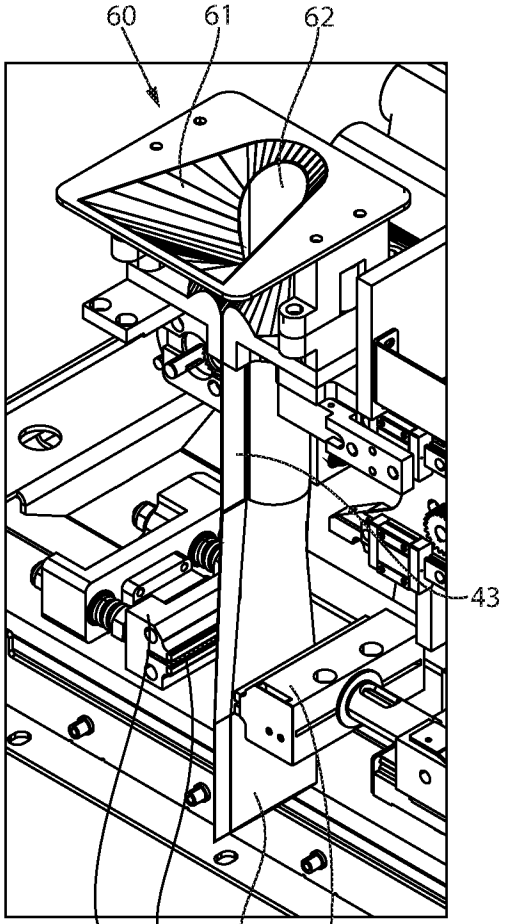

FIG. 8*a* shows the course of the packaging material web 41 with the overlap region 43. The joining elements 91*a*, 91*b* are illustrated in an open position, and the blister tube 45 is indicated below the joining elements 91*a*, 91*b*.

In FIG. 8*b*, the packaging material 41 is not shown, and the conveying segment 62 of the guide device 60 can be seen, which extends through the central passage 51 of the folding and conveyance device 50, which is shown in FIG. 8*c*. The conveying segment 62 supports the formation and shaping of the tubular packaging material web 42, and feeds the drug portions to the actual receiving space of the pre-shaped packaging material web 41, which is positioned below the conveying segment 62.

FIG. 9*a* shows how the elements listed above are installed in the device 1. The conveying segment 62 of the guide device 60 extends through a central passage 51 of the folding and conveyance device 50. In FIG. 9*b*, the guide device 60 is shifted vertically with respect to the folding and conveyance device 50. In FIG. 9*c*, the guide device 60 and the folding and conveyance device 50 are illustrated separately from each other. The shaping of the packaging material web 41 is, in some implementations, performed by the packaging material web 41 travelling up the sides of the folding and conveyance device 50 toward the central passage 51, and extending downward into the central passage 51. In some implementations, the central passage 51 of the folding and conveyance device 50 is not closed to the outside. Rather, it includes a gap 53, and this gap 53 forms the packaging material overlap region 43 when the packaging material web 41 is shaped. A corresponding overlap area could also be formed, in other implementations of the present disclosure, by other implementations of the central passage 51 and/or the folding and conveyance device 50.

Figure 10B:
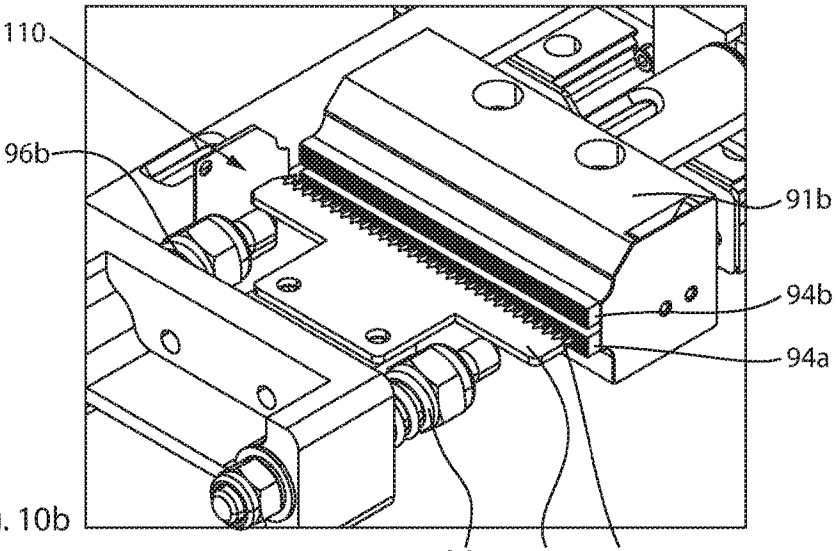
FIGS. 10*a*-10*c* are views of joining elements of a second joining device, according to exemplary implementations of the present disclosure.
Figure 10A:
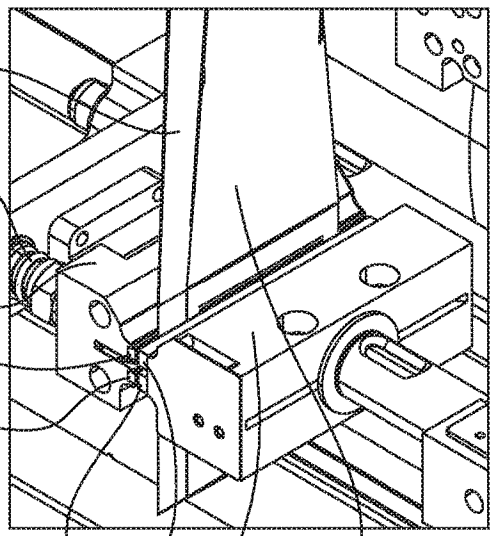
Figure 10C:
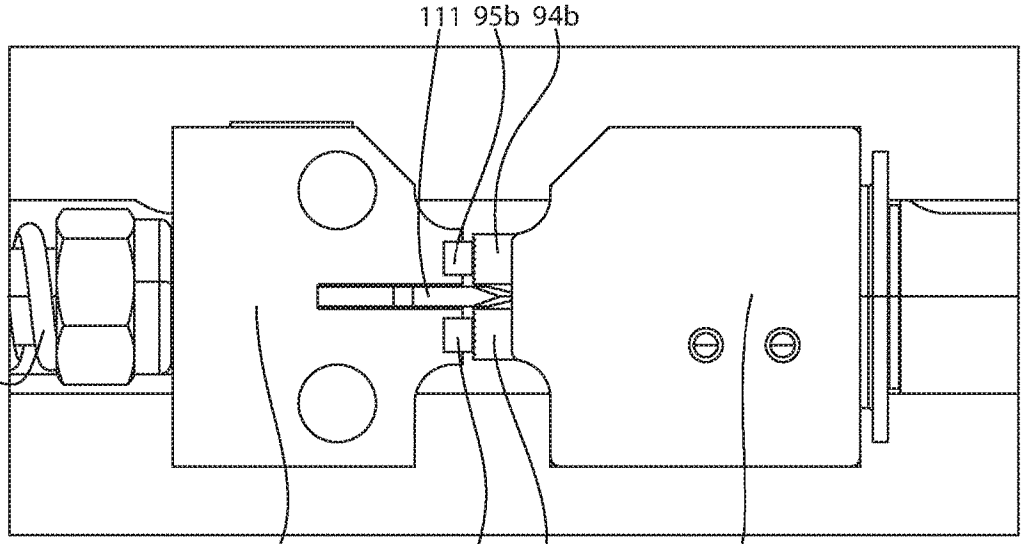

FIG. 10*a* shows a joining site transverse to the direction D1 of movement of the packaging material web 41. The joining element 91*a* is attached to the cutting element 111. The joining element 91*a* has, downstream and upstream of the cutting element 111, welding edges 94*a*, 94*b* which cooperate with counter edges 95*a*, 95*b* of the joining element 91*b*. FIG. 10*b* shows the cutting device 110, which includes a cutting element 111 with a plurality of cutting teeth 112. The cutting element 111 in some implementations is connected directly to the horizontal adjustment device 93. The joining element 91*a* is connected to said horizontal adjustment device 93 via springs 96*a*, 96*b*. A movement of the horizontal adjustment device 93 therefore moves both the joining element 91*a* and the cutting element 111. However, as soon as the joining element 91*a* is moved via its weld edges against a stop, which is typically furnished via the counter edges 95*a*, 95*b*, a movement of the cutting element 111 relative to the joining element 91*a* is produced, caused particularly by the joining element 91*a* being pressed via the joining element 91*b*, which is coupled with a horizontal adjustment device 93, against the springs 96*a*, 96*b* as shown in FIG. 10*c*.

During the movement of the cutting element 111 relative to the joining element 91*b*, the cutting element 111 passes away from, or out of a recess inside, the joining element 91*a*, and penetrates the packaging material web 41 arranged between the joining elements 91*a*, 91*b*. The packaging material web 41 can be perforated or severed by the cutting teeth 112 according to this relative movement. The perforation is created only by a small relative movement. If the joining element 91*a* is further pressed against the springs 96*a*, 96*b* via the joining element 91*b*, the packaging material web 41 is severed.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to indicate "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject technology.

The word "exemplary" or the term "for example" is used herein to indicate "serving as an example or illustration." Any aspect or design described herein as "exemplary" or "for example" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations or processes disclosed is an illustration of exemplary approaches. Based upon design preferences, it is understood that the specific order or hierarchy of steps, operations or processes may be rearranged. Some of the steps, operations or processes may be performed simultaneously. Some or all of the steps, operations, or processes may be performed automatically, without the intervention of a user. The accompanying method claims, if any, present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102 or 103, nor should they be interpreted in such a way.

What is claimed is:

1. A device for packaging drug portions, the device comprising:

a plurality of reservoir and dispensing stations for dispensing individual drug portions;

at least one conveyance and collecting apparatus for receiving and transferring the drug portions dispensed by the reservoir and dispensing stations;

a packaging material feed for feeding a flexible and elongated packaging material web; and a packaging device, comprising:

a folding and conveyance device, the folding and conveyance device having a packaging material receiving area including a passage, where the elongated packaging material web is fed into the passage and is molded into a tubular packaging material web, the shape of which is defined by the passage, the passage at least partially defining a packaging material overlap region;

a guide device including a receiving segment and a conveying segment, the conveying segment extending along the passage of the folding and conveyance device and guides drug portions into the tubular packaging material web;

a first joining device arranged downstream of the folding and conveyance device for seaming the tubular packaging material web at the packaging material overlap region in a direction of movement of the tubular packaging material web, wherein the first joining device comprises two joining elements, two drive belts and two drives, wherein each joining element is actuated by a corresponding drive belt and drive; and a second joining device arranged downstream of the first joining device, which seams the tubular packaging material web at pre-specified intervals with respect to the direction of movement of the tubular packaging material web, such that a continuous blister tube is created, wherein the second joining device includes a drive device for moving the second joining device in, and opposite to, the direction of movement of the tubular packaging material web.

2. The device for packaging drug portions according to claim 1, further comprising a cutting element disposed within a recess of a joining element of the second joining device, the cutting element configured to move into and out of the recess.

3. The device for packaging drug portions according to claim 2, wherein the cutting device is operatively associated with the second joining device.

4. The device for packaging drug portions according to claim 1, wherein the second joining device seams the tubular packaging material web by welding.

5. The device for packaging drug portions according to claim 1, wherein the folding and conveyance device narrows conically at substantially a center of the folding and conveyance device.

6. The device for packaging drug portions according to claim 1, wherein the folding and conveyance device includes a raised conical form.

7. The device for packaging drug portions according to 6, wherein the raised conical form includes the passage therethrough.

8. The device for packaging drug portions according to claim 1, wherein the first joining device is arranged on a receiving plate.

9. The device for packaging drug portions according to claim 1, wherein the second joining device comprises two joining elements and two independently movable horizontal adjusting mechanisms.

10. The device for packaging drug portions according to claim 2, wherein the cutting element includes a plurality of cutting teeth, and the blister tube and the cutting element are movable relative to each other to sever or perforate the blister tube.

11. A method of forming a blister tube containing drug portions with a packaging device, comprising:

molding an elongated packaging material into a tubular packaging material web by a folding and conveyance device having a packaging material receiving area including a passage, where the elongated packaging material web is fed into the passage and is molded into the tubular packaging material web, the shape of which is defined by the passage, the passage at least partially defining a packaging material overlap region;

guiding drug portions into the tubular packaging material web by a guide device that includes a receiving segment and a conveying segment, the conveying segment extending along the passage of the folding and conveyance device;

seaming the tubular packaging material web at the packaging material overlap region in a direction of movement of the tubular packaging material web by a first joining device arranged downstream of the folding and conveyance device, the first joining device comprising a first joining element actuated by a first drive belt and first drive, and a second joining element actuated by a second drive belt and second drive; and seaming the tubular packaging material web at pre-specified intervals with respect to the direction of movement of the tubular packaging material web by a second joining device arranged downstream of the first joining device, such that a continuous blister tube is created.

12. The method of claim 11, further comprising:

moving, by a drive device of the second joining device, the second joining device in, and opposite to, the direction of movement of the tubular packaging material web.

13. The method of claim 11, further comprising:

severing, by a cutting device with a cutting element, the blister tube at pre-specified intervals with respect to the direction of movement of the tubular packaging material.

14. The method of claim 13, further comprising:

moving the cutting element that includes a plurality of cutting teeth to sever or perforate the blister tube.

15. The method of claim 13, further comprising:

operatively associating the cutting device with the second joining device.

16. The method of claim 13, further comprising:

accommodating the cutting element in a joining element of the second joining device.

17. The method of claim 11, further comprising:

seaming, by the second joining device, the tubular packaging material web by welding.

* * * * *